US005969587A

United States Patent [19]

Combas

[11] Patent Number: 5,969,587

[45] Date of Patent: Oct. 19, 1999

[54] AUXILIARY SWITCH FOR CIRCUIT-BREAKER AND CORRESPONDING CIRCUIT-BREAKER

[75] Inventor: Christian Combas, Ambazac, France

[73] Assignees: Legrand; Legrand SNC, both of Limoges, France

[21] Appl. No.: 08/770,162

[22] Filed: Dec. 19, 1996

[30] Foreign Application Priority Data

Dec. 20, 1995 [FR] France ..... 95 15136

[51] Int. Cl.[6] ..... H01H 67/02

[52] U.S. Cl. ..... 335/132; 335/202; 337/186

[58] Field of Search ..... 335/6, 13, 17, 335/106, 132, 202; 337/186, 187, 188, 208, 209, 211, 212

[56] References Cited

U.S. PATENT DOCUMENTS

| | | | |
|---|---|---|---|
| 3,435,389 | 3/1969 | Mikolic | 335/121 |
| 3,820,046 | 6/1974 | Layton | 335/13 |
| 4,345,225 | 8/1982 | Lemmer | 335/132 |
| 4,485,365 | 11/1984 | Lerude et al. | 335/132 |
| 4,774,484 | 9/1988 | Lehman et al. | 335/197 |
| 4,926,148 | 5/1990 | Cambreleng | 335/13 |
| 5,194,705 | 3/1993 | Canault . | |

FOREIGN PATENT DOCUMENTS

| | | |
|---|---|---|
| 0431994 | 6/1991 | European Pat. Off. . |
| 2551915 | 3/1985 | France . |
| 2638562 | 5/1990 | France . |

*Primary Examiner*—Lincoln Donovan
*Assistant Examiner*—Tuyen T. Nguyen
*Attorney, Agent, or Firm*—Young & Thompson

[57] ABSTRACT

An auxiliary switch for a circuit-breaker includes a casing containing at least one contact blade member mobile under the control of a pivoting and sliding actuator lever between a closed position and an open position. The actuator lever has a lateral actuator pin which projects out of the casing through a slot in the latter. The slot has a localized escape lobe away from its main part and which receives the actuator pin.

17 Claims, 5 Drawing Sheets

AUXILIARY SWITCH FOR CIRCUIT-BREAKER AND CORRESPONDING CIRCUIT-BREAKER

BACKGROUND OF THE INVENTION

1. Field of the Invention

The present invention concerns circuit-breakers.

2. Description of the Prior Art

A circuit-breaker includes a casing containing two spaced contact members electrically connected to respective terminals accessible from outside the casing and a fuse-holder, often called a "holder", that has a housing adapted to accommodate a cartridge fuse, is accessible to the user from outside the casing and is mobile in the casing between two positions, namely a closed position in which the housing extends from one of the two contact members to the other, so that a cartridge fuse in the housing makes an electrical connection between them, and an open position in which the housing is separated from the contact members and lies partly outside the casing, so that the user can insert a cartridge fuse in it or remove a cartridge fuse from it.

French patent application 94 15332 of Dec. 20, 1994 proposes to associate an auxiliary device with the above circuit-breaker, movement of the fuse-holder between its two positions operating the auxiliary device.

To this end cam means are provide on the fuse-holder and the auxiliary device has an operating rod projecting from its casing and inter-engaged with the cam means.

A general object of the present invention is to improve on this arrangement, by applying it to a switch adapted to control the power supply to another circuit, for example an indicator lamp, according to the position (opened or closed) of the fuse-holder of the circuit-breaker.

French patent 2 638 562 describes an auxiliary switch having a casing containing a contact blade member mobile between two positions under the control of a pivoting and sliding actuator lever, namely a closed position in which it is pressed against a fixed contact and an open position in which it is separated from the fixed contact.

However, the actuator lever is operated by a pusher member and there is no mention of associating it with any form of actuator pin.

Thus the above auxiliary switch cannot be easily associated with a circuit-breaker of the kind of interest here, and the latter gives rise to a particular problem any way, in that its fuse-holder has a relatively large range of movement so that the cam means that it incorporates must inter-engage only momentarily, "on the fly", with an auxiliary switch of this kind.

A first more specific object of the present invention consists in an auxiliary switch that meets this two-fold requirement.

SUMMARY OF THE INVENTION

The invention consists in an auxiliary switch for a circuit-breaker comprising a casing containing at least one contact blade member at least partly mobile, under the control of a pivoting and sliding actuator lever, between two positions, namely a closed position in which it is pressed against a fixed contact and an open position in which it is separated from said fixed contact, said actuator lever comprising a lateral actuator pin projecting out of said casing through a slot therein having a localized escape lobe away from its main part adapted to receive said actuator pin.

Accordingly, after its cam means have momentarily entrained the actuator pin of the auxiliary switch, the fuse-holder of the circuit-breaker directs the actuator pin towards the escape lobe of the slot in which it moves and the fuse-holder can therefore continue its movement with no further interference of any kind between it and the actuator pin.

On the return stroke, the cam means of the fuse-holder return the actuator pin to the main part of the slot, to be entrained in the opposite direction.

A second object of the present invention consists in a circuit-breaker in which the fuse-holder has cam means designed accordingly.

The objects of the invention, their features and their advantages will emerge from the following description given by way of example with reference to the accompanying diagrammatic drawings.

DETAILED DESCRIPTION OF THE PREFERRED EMBODIMENT

Figure 1:
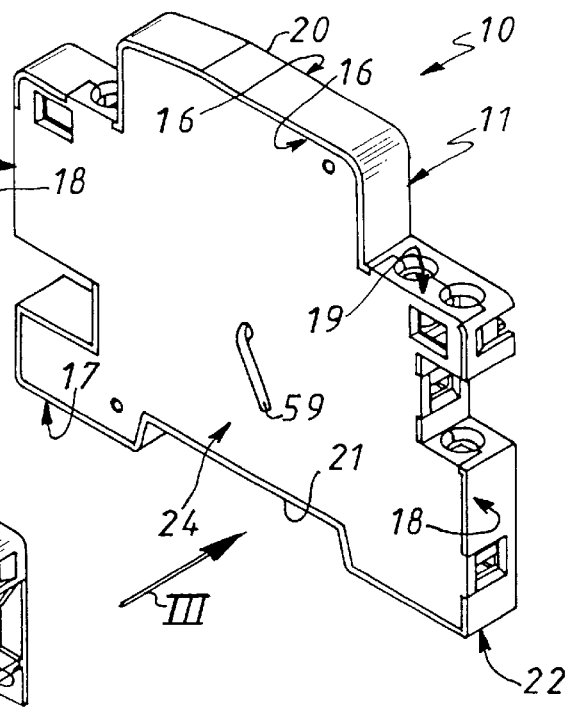
FIG. 1 is a perspective view of an auxiliary switch in accordance with the invention, seen from the side of the cover of its casing.
Figure 2:
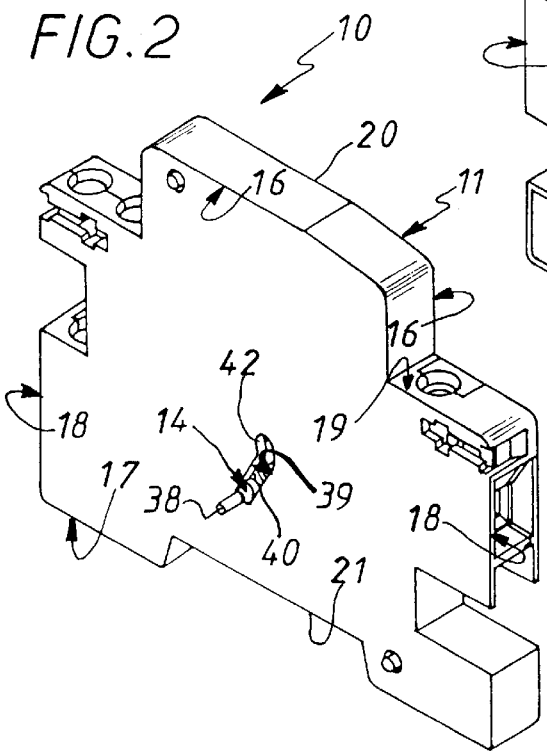
FIG. 2 is another perspective view of it, seen from the side of the base of its casing.

As shown in the figures, and most clearly in FIG. 3, the auxiliary switch 10 of the invention comprises, in a manner that is known in itself, a casing 11 containing at least one contact blade member 12A which is at least partly mobile, under the control of a pivoting and sliding actuator lever 14, the mounting arrangements of which are described in more detail later, between two positions, namely a closed position shown in FIG. 3 in which it is pressed against a fixed contact 15A and an open position shown in FIG. 7B in which it is separated from the fixed contact 15A.

In the embodiment shown the auxiliary switch 10 is a modular device.

Its casing 11 is therefore generally flat with two parallel principal faces 16 and, around its contour, a rear face 17, two substantially parallel lateral faces 18 perpendicular to the rear face 17 and a front face 19 which is substantially parallel to the rear face 17 except for a projecting part 20 in its middle portion.

The rear face 17 incorporates a notch 21 adapted to inter-engage with a snap-fastener device, not shown, for fixing the device as a whole to a standardized type of support rail, also not shown.

In the embodiment shown the casing 11 comprises a base 22 which forms a box body and the bottom 23 of which forms one of the principal faces 16 and a cover 24 attached and fastened to the base 22 and forming the other principal face 16.

The arrangements described above are well known in themselves and, as they do not themselves constitute any part of the present invention, they are not described in more detail here.

Figure 3:
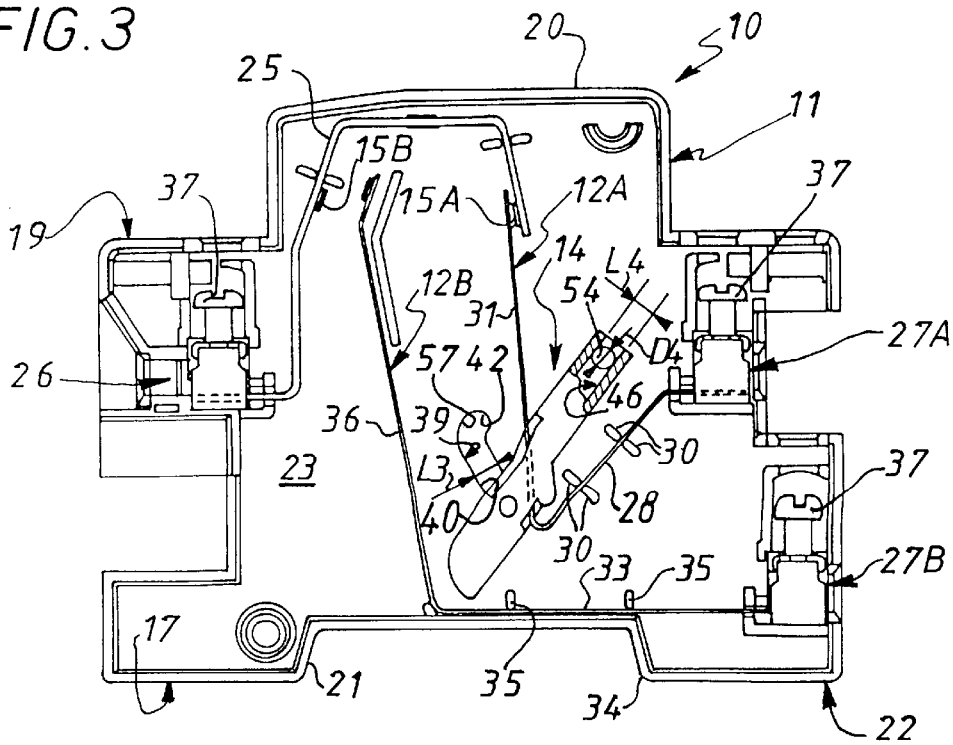
FIG. 3 is an interior elevation view in the direction of the arrow III in FIG. 1, partly cut away and with the cover of the casing removed.
Figure 4:
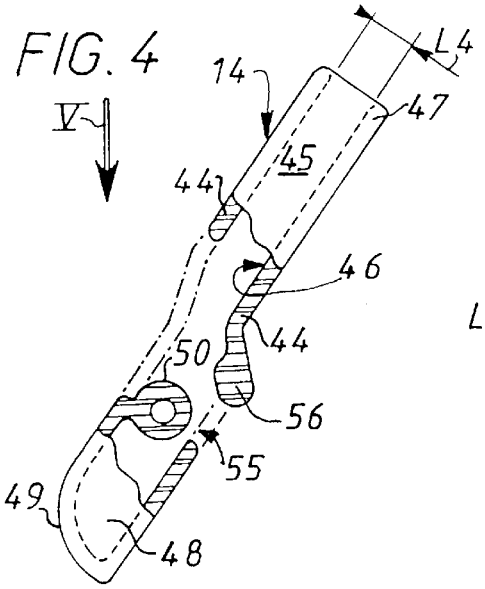
FIG. 4 is a partly cut away elevation view to a larger scale of the actuator lever of the auxiliary switch.
Figure 7A:
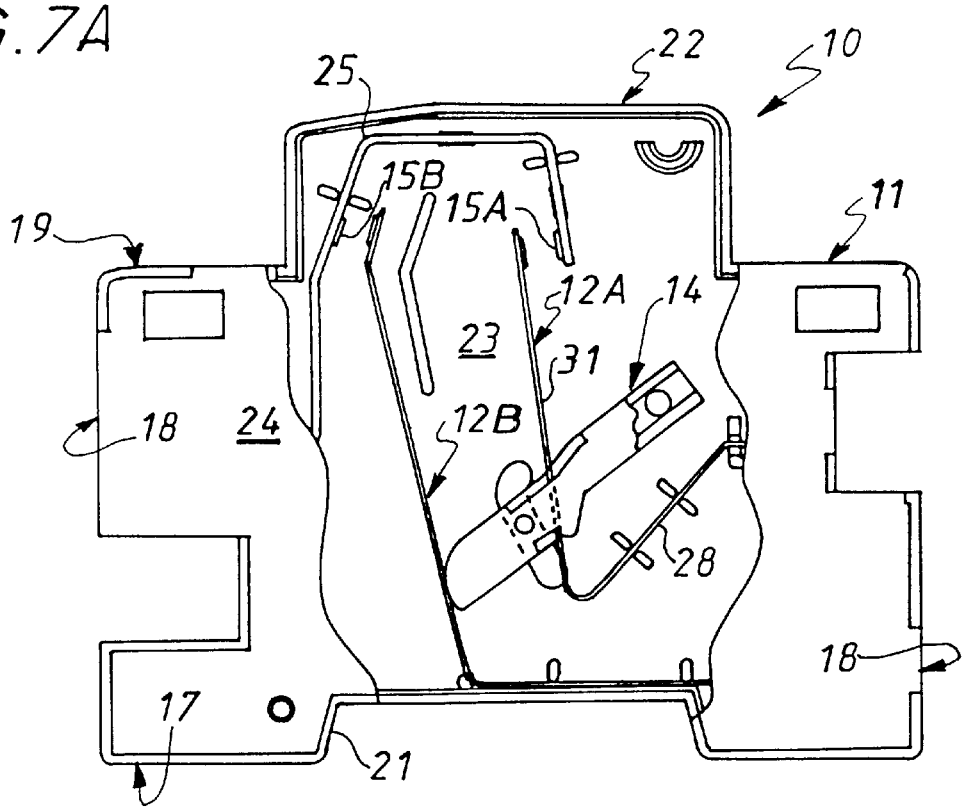
FIGS. 7A and 7B are locally cut away elevation views based on that of FIG. 3, showing respective successive phases of operation of the auxiliary switch of the invention.
Figure 7B:
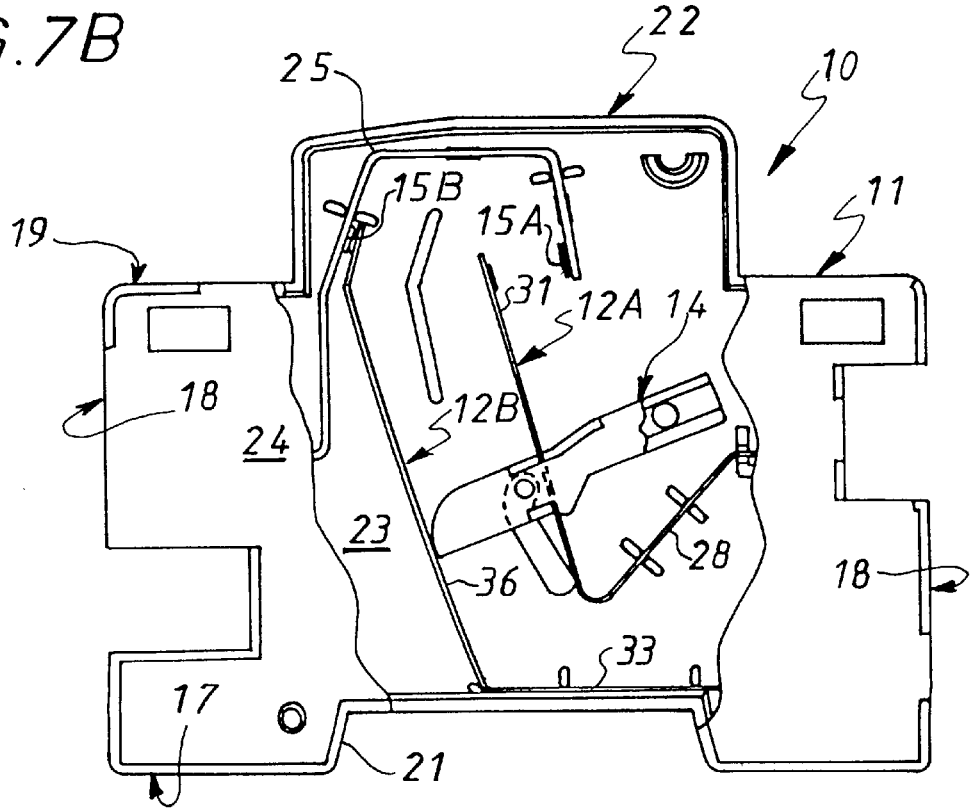

In the embodiment shown, the auxiliary switch 10 of the invention includes a second contact blade member 12B which is also partly mobile, under the control of the actuator lever 14, between two positions, namely a closed position shown in FIG. 7B in which it is pressed against a second fixed contact 15B and an open position shown in FIG. 3 in which it is separated from the fixed contact 15B.

To be more precise, in the embodiment shown the auxiliary switch 10 of the invention constitutes a double-throw switch, the two fixed contacts 15A, 15B being carried by a common metal strip 25 connecting them to an input terminal 26. The two contact blade members 12A, 12B are individually connected to output terminals 27A, 27B. One is in the closed position when the other is in the open position and vice-versa.

The contact blade member 12A is in practise fixed to the casing 11 at one end and its other, free end cooperates with the associated fixed contact 15A.

To be more precise, in the embodiment shown, the contact blade member 12A has two sections, namely a fixed section 28 connected to the output terminal 27A and inserted between studs 30 in one piece with the bottom 23 of the base 22 of the casing 11 and a mobile section 31 on which the actuator lever 14 acts in a manner to be described in more detail below and which cooperates with the fixed contact 15A.

In the embodiment shown the fixed section 28 and the mobile section 31 are at an acute angle to each other.

Similarly, the second contact blade member 12B is fixed to the casing 11 at one end and its other, free end cooperates with the associated fixed contact 15B.

To be more precise, and in the same way as the contact blade member 12A, in the embodiment shown the contact blade member 12B has a fixed section 33 connected to the output terminal 27B and inserted between the part of the rim 34 of the base 22 of the casing 11 forming the rear face 17 of the latter and studs 35 in one piece with the bottom 23 of the base 22 and a mobile section 36 on which the actuator lever 14 acts and through which it cooperates with the fixed contact 15B.

In the embodiment shown the fixed section 33 and the mobile section 36 are at an obtuse angle to each other.

The input terminal 26 opens onto one of the lateral faces 18 of the casing 11. The output terminals 27A, 27B open onto the opposite lateral face 18 at staggered positions on the latter.

However, the clamping screw 37 of each of these terminals is accessible from the front face 19 of the casing 11.

In accordance with the invention, the actuator lever 14 includes a lateral actuator pin 38 which projects out of the casing 11 through a slot 39 in the latter, as described in more detail below. The slot 39 has a localized escape lobe 42 spaced from its main part 40 and adapted to receive the actuator pin 38.

In the embodiment shown the actuator lever 14 has the overall form of a hollow bar, with a U-shape cross-section.

It therefore has two substantially parallel flanks 44 which, apart from a curve in their middle portion, are substantially rectilinear and a flat bottom 45 substantially perpendicular to the flanks 44.

A groove 46 is formed between the flanks 44.

At one end 47 of the actuator lever 14 the groove 46 is open. At the other end 48 it is closed, one of the flanks 44 being joined to the other via a rounded profile 49.

Figure 5:
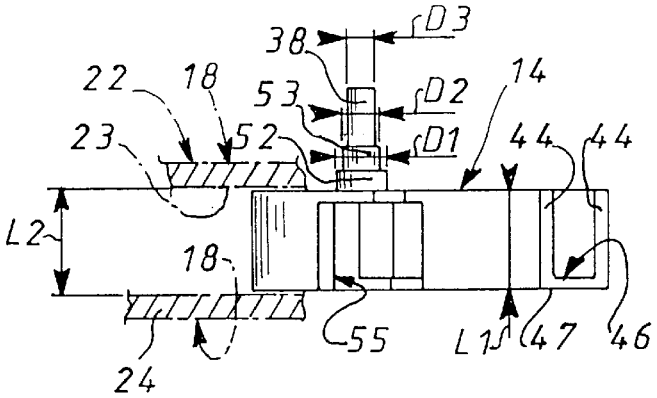
FIG. 5 is a plan view of the actuator lever as seen in the direction of the arrow V in FIG. 4.
Figure 6:
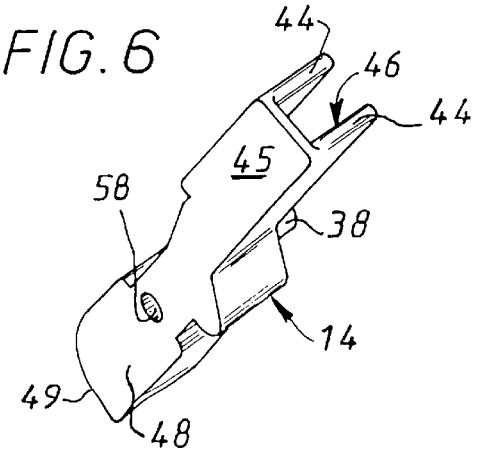
FIG. 6 is a perspective view of it.

The resulting actuator lever 14 has its concave side facing towards the bottom 23 of the base 22 of the casing 11 and, in order for the casing to guide its movement, its width L1, i.e. the distance between the exteriors of the two flanks 44, is substantially equal to (slightly less than) the interior distance L2 between the bottom 23 and the cover 24, as shown schematically in chain-dotted outline in FIG. 5.

The actuator pin 38 is carried by a block 50 in one piece with the bottom 45, substantially perpendicular to the latter and extending between the flanks 44, at a distance from both ends 47, 48 but nearer the open end 47 than the closed end 48.

In practise the actuator pin 38 has an enlarged section 52 at the base to guide it, the diameter D1 of the latter section being substantially equal to (slightly less than) the width L3 of the slot 39 in the casing 11.

In the embodiment shown, it also has a section 53 the diameter D2 of which is between that D1 of the section 52 and the diameter D3.

Pivoting and sliding of the actuator lever 14 are achieved by inter-engagement of the open end 47 of its groove 46 with a lug 54 on the casing 11 (FIG. 3).

The lug 54 is in practise cylindrical with a circular cross-section and is in one piece with the bottom 23 of the base 22 of the casing 11. Its diameter D4 is substantially equal to (slightly less than) the interior width L4 between the two flanks 44 of the actuator lever 14.

The actuator lever 14 has a transverse opening 55 in its middle portion, i.e. between its ends 47, 48, which is in practise restricted to its flanks 44, without encroaching on its bottom 45. To enable the actuator lever 14 to operate the contact blade member 12A, the contact blade member 12A passes through this opening.

To be more precise, the actuator lever 14 has, flanking this opening 55, a rounded boss 56 that is in one piece with one flank 44, in this instance that opposite the one having a rounded profile 49 at the closed end 48, forming a localized enlargement of this flank 44, so to speak, through which it acts on the contact blade member 12A.

The block 50 carrying the actuator pin 38 also flanks the openings 55, but on the side of the latter opposite the boss 56, and is in one piece with the flank 44 having a rounded profile 49 at the closed end 48.

In practise, in the closed position shown in FIG. 3, the contact blade member 12A is pressed against the associated fixed contact 15A by virtue of its inherent elasticity, and the boss 56 on the actuator lever 14 is on the same side of the contact blade member 12A as the fixed contacts 15A, at a slight distance from the contact blade member 12A.

The contact blade member 12B is on the opposite side of the actuator pin 38 of the actuator lever 14 to the contact blade member 12A.

One end of the actuator lever 14 acts on the contact blade member 12B, in this instance the closed end 48 having a rounded profile 49.

At least one of the contact blade members 12A, 12B is at least partly elastically deformable and therefore of itself constitutes spring means adapted to hold the actuator lever 14 in a stable manner in at least one of its positions.

In practise this is the contact blade member 12B, i.e. the one elastically loaded by the actuator lever 14 when it is in the closed position.

In the embodiment shown the escape lobe 42 that the slot 39 in the casing 11 forms is in practise at one end of the main part 40 of the latter.

In the embodiment shown the escape lobe 42 is in practise reduced to a right-angle extension of the main part 40, merging with the latter through a broadly rounded section 57, and the main part 40 is substantially rectilinear.

In the embodiment shown the actuator lever 14 has, on the side opposite its actuator pin 38, in the block 50 carrying the latter, a lateral bore 58 axially aligned with the actuator pin 38 and in corresponding relationship to which the casing 11, to be more precise the cover 24 of the latter, has a slot 59 of the same kind as the slot 39 for the actuator pin 38.

The circuit breaker 60 with which the resulting auxiliary switch 10 may be associated is described in French patent application No. 94.15332. The relevant drawings thereof are illustrated in FIGS. 11, 12, 13 and 14 and the relevant portions of the description of that application follow.

Figure 11:
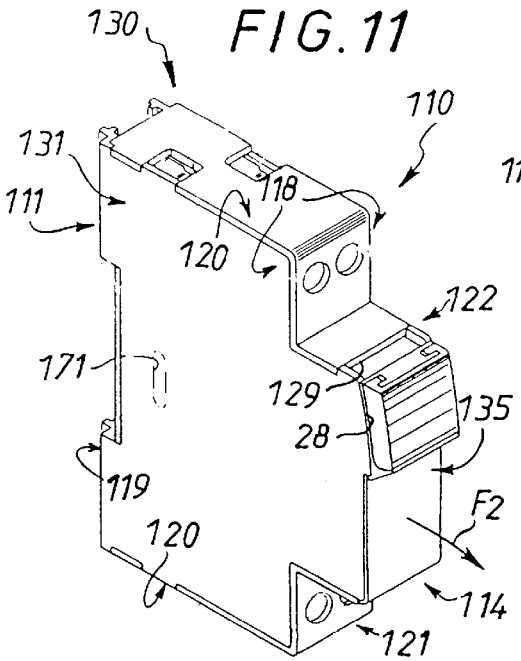
FIG. 11 is a perspective view of an auxiliary switch as shown in FIG. 1 of French patent application No. 94.15532.
Figure 12:
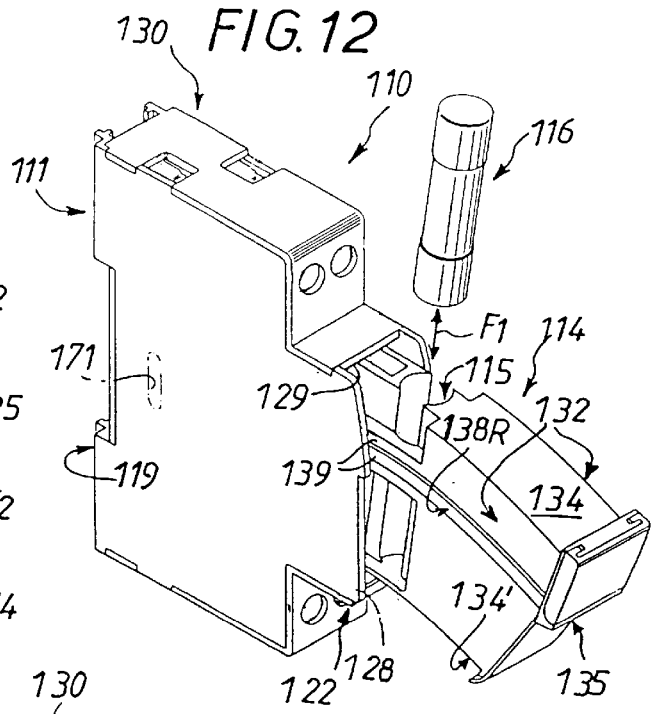
FIG. 12 is another perspective view of the auxiliary switch of FIG. 11 showing the fuse holder in its open position.
Figure 13:
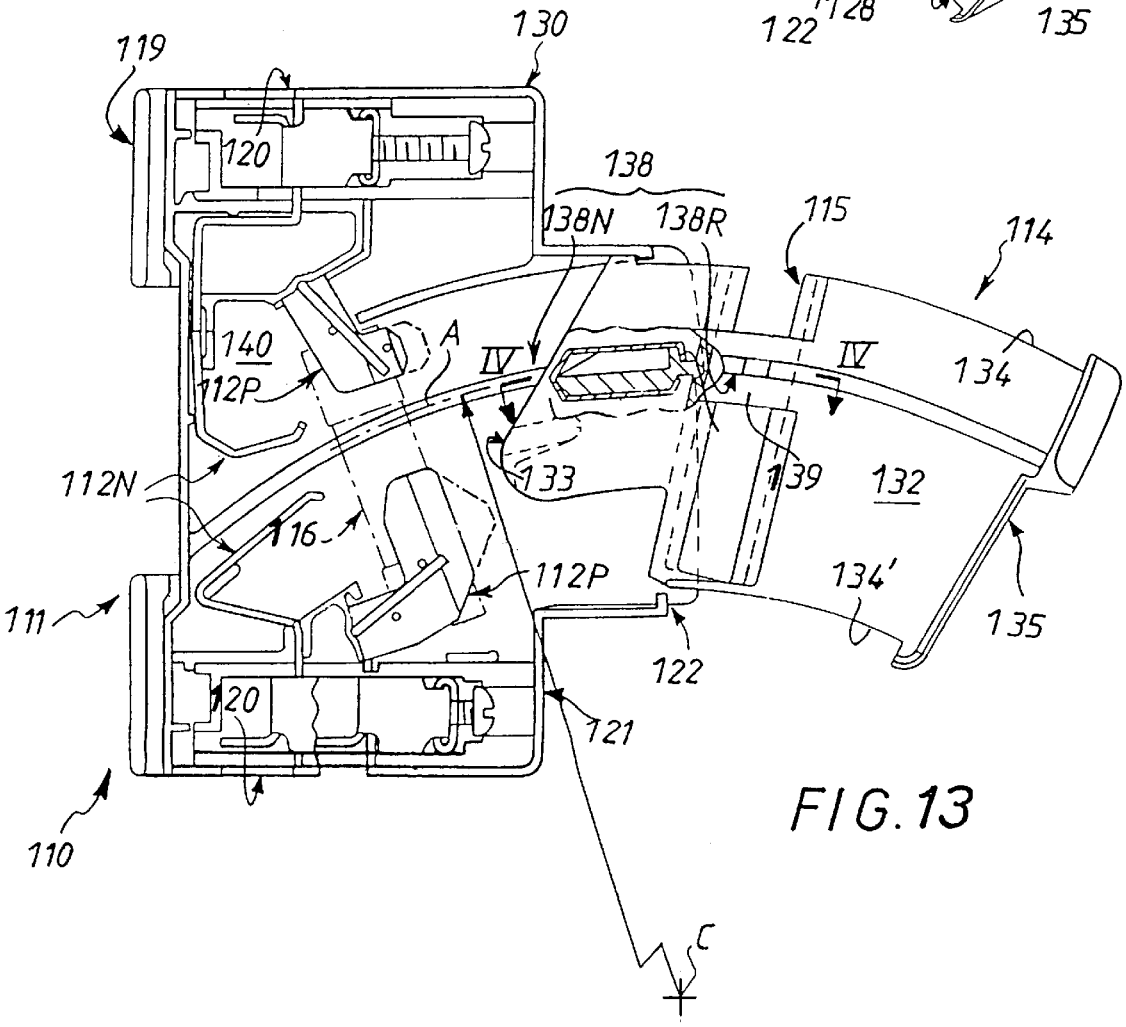
FIG. 13 is a sectional view of the auxiliary switch in the position illustrated in FIG. 12.

As shown in FIGS. 11–14, and in a manner which is known per se, the auxiliary switch 110 includes, in a casing 111, on the one hand, two spaced contact members 112P electrically connected to respective connecting terminals 113P accessible from outside the casing 111 and, on the other hand, a fuse-holder 114 which has a recess 115 adapted to accommodate a cartridge fuse 116 and is accessible from outside the casing 111. The fuse-holder is mounted to slide between two positions, namely a retracted or closed position, shown in FIG. 11 where recess 115 extends from one of the two contact members 112P to the other so that, as shown in chain-dotted outline in FIG. 13, a cartridge fuse 116 in the recess 115 is then electrically connected between the contact members 112P and a deployed or open position, as shown in FIGS. 12 and 13 where the cartridge fuse is out of contact with the contact members 112P, recess 115 being at least partly outside the casing 111, as shown diagrammatically by a double-headed arrow F1 in FIG. 12. It is thus possible to place a cartridge fuse 116 in the recess 115 or remove a cartridge fuse from the recess 115.

The front part 128 of the protrusion 122, which also forms the front part of the casing 111, is open so that the fuse-holder 114 can pass therethrough, a set back recess 129 enabling the back of the fuse-holder 114 to be gripped in the closed position to apply traction or pull the fuse-holder in the direction of the arrow F2 in FIG. 11.

In practice, the resulting casing 111 comprises a base 130 which defines in one piece construction one of the main faces 118, rear face 119, lateral faces 120 and a front face 121 and a cover 131 which defines the other main face 118, and fits onto a rebate on the base 130 and is fastened to the base 130, for example ultrasonically welded to it.

In a manner also known per se, the fuse-holder 114 comprises a plate, slightly thinner than the casing 111, and slidable parallel to the main faces 118 thereof, like a drawer.

The fuse-holder 114 therefore has two main faces 132 and, a rear edge 133, two lateral faces 134, 134' and a front face 135.

The fuse-holder 114 follows a curved path between its open and closed positions.

If guide means 138 are operative between the fuse-holder 114 and the casing 111 to control the path of movement, the guide means 138 are generally curved.

In the embodiment of FIGS. 11–14, the guide means 138 include at least one groove 138R recessed into the fuse-holder 114 and in corresponding relationship thereto at least one complementary rib 138N projecting into the casing 111 and engaged with the groove 138R.

In practice two grooves 138R are provided on the fuse-holder 114, one on each main face 132 thereof, and extend generally from rear face 133 to front face 135, and comprise two parallel ribs 139 over at least a part of their length.

Two ribs 138N are provided in the casing 111, one on each main face 118, one of the ribs 138N projecting on the inside surface of the back wall 140 of the base 130 and the other projecting from the inside surface of the cover 131.

In practice, the fuse-holder 114 is curved like the guide means 138.

Figure 14:
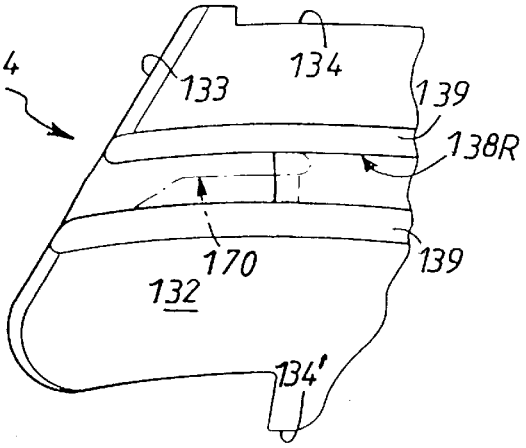
FIG. 14 is a partial view, on a greater scale, of the actuator lever, as illustrated in FIG. 13.

As shown diagrammatically in chain-dotted outline in FIGS. 11, 12 and 14, the relatively large relative movement of the fuse-holder 114 is utilized for controlling an auxiliary device of any kind, if required.

To this end the fuse-holder 114 has, for example, projecting from the bottom of one of its grooves 138R, cam means 170 on the path of which the casing 111 has an opening 171.

All that is required is that the auxiliary device to be operated conjointly have an appropriate projecting actuating rod and adjoin the auxiliary switch 110.

Entering the auxiliary switch 110 through the opening 171 in the casing 111, this operating rod is actuated by the cam means 170 of the fuse-holder 114 when it moves from its closed position to its open position.

We now return to the description of the preferred embodiment of the present invention.

Figure 8:
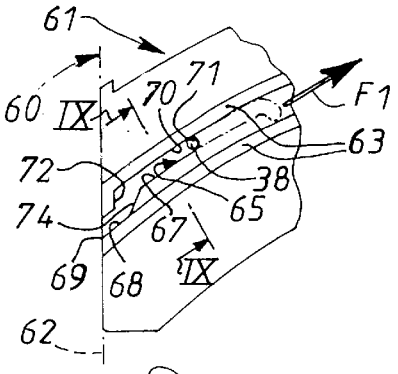
FIG. 8 is a partial elevation view of the fuse-holder of the circuit-breaker with which the auxiliary switch may be associated.
Figure 10A:
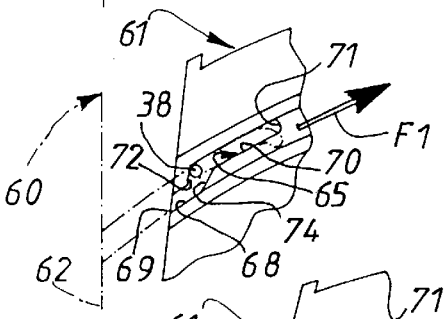
FIGS. 10A, 10B and 10C are partial plan views analogous to that of FIG. 8, showing various successive phases of operation of the device as a whole.
Figure 10B:
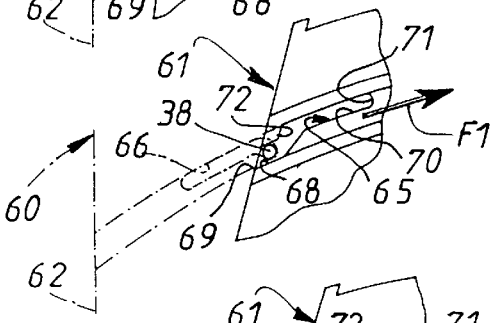
Figure 10C:
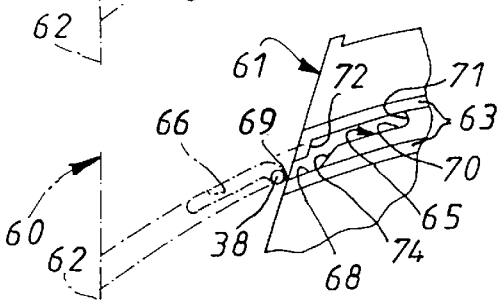

Suffice to say that the circuit breaker 60 includes a fuse-holder 61 mobile between two positions, namely a closed position shown in FIG. 8 and an open position shown in FIG. 10C.

In practise, the fuse-holder 61 moves along a curved path.

To be more precise, it is curved overall and it is inter-engaged with guide means attached to the casing 62 of the device and curved overall in a complementary way.

Figure 9:
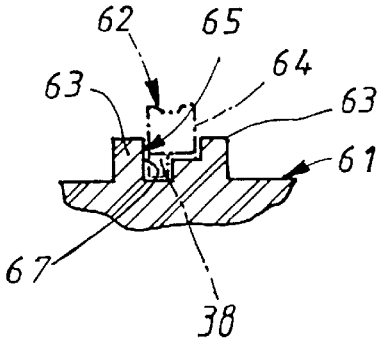
FIG. 9 is a partial view of the fuse-holder in cross-section on the line IX—IX in FIG. 8.

To be even more precise, the fuse-holder 61 has two projecting ribs 63 through which it is inter-engaged with a rib 64 on the casing 62 of the circuit-breaker 60, as shown diagrammatically in chain-dotted outline in FIG. 9.

The fuse-holder 61 of the circuit-breaker 60 incorporates cam means 65 for actuating the auxiliary switch 10 on the path of which the casing 62 of the circuit-breaker 60 has an opening 66 through which the actuator pin 38 of its actuator lever 14 passes, the opening 66 being in practise a slot of the same kind as the slots 39, 59 in the casing 11 of the auxiliary switch 10.

As described in French patent application 94 15332, the cam means 65 include a groove 67 in the fuse-holder 61, between the ribs 63, with which the actuator pin 38 is engaged, as shown diagrammatically in chain-dotted outline in FIG. 9.

In practise, and in accordance with the invention, the groove 67 has two successive sections offset transversely relative to each other, namely a first section 68 which opens freely through an outlet 69 at the end of the fuse-holder 61 onto the edge of the latter and a second section 70 which has a blind end 71. Where the two sections 68, 70 merge, there is an entrainment flat 72 on a first flank of the groove 67 facing towards the blind end 71 of the second section 70 and adapted to entrain the actuator pin 38. On the other flank of the groove 67, between the blind end 71 of the second section 70 and the entrainment flat 72, there is a deflector flat 74 facing towards the outlet 69 of the first section 68 and adapted to deflect the actuator pin 38.

Taken overall, the groove 67 is globally curved, imaging the curved path of the fuse-holder 61.

At the assembly stage, when the auxiliary switch 10 of the invention is placed against the associated circuit-breaker 60 and the fuse-holder 61 of the circuit-breaker 60 is in the closed position, as shown in FIG. 8, the actuator pin 38 of the auxiliary switch 10 is engaged with the groove 67 forming the cam means 65 of the fuse-holder 61, being on the same side as the blind end 71 of the second section 70 of the groove 67, as shown diagrammatically in chain-dotted outline in FIG. 8.

When the fuse-holder 61 is opened (arrow F1 in FIGS. 8, 10A and 10B), it first moves without moving the actuator pin 38 of the auxiliary switch 10, until the entrainment flat 72 of its groove 67 comes into contact with the actuator pin 38, as shown diagrammatically in chain-dotted outline in FIG. 10A.

The actuator pin 38 is then entrained by the fuse-holder 61 along the main part 40 of the slot 39 in the casing 11 of the auxiliary switch 10.

Initially, as shown in FIG. 7A, the boss 56 of the actuator lever 14 of the auxiliary switch 10 bears on the contact blade member 12A, which causes the latter to move to the open position; its closed end 48 also bears on the contact blade member 12B.

Then, as shown in FIG. 7B, the actuator lever 14 moves the contact blade member 12B to the closed position, accentuating the opening of the contact blade member 12A.

When, as shown in FIG. 7B, and as shown diagrammatically in chain-dotted outline in FIG. 10B, the actuator pin 38 of the auxiliary switch 10 reaches the escape lobe 42 of the slot 39 in the casing 11, it is directed towards the escape lobe 42 by the broadly rounded section 57 of the slot 39 so that, as shown in figure 10B, the fuse-holder 61 of the circuit-breaker 60 can continue to move freely to its final open position.

The fuse-holder 61 is returned to the closed position by a process that is the reverse of the above process.

Firstly, the groove 67 forming the cam means 65 of the fuse-holder 61 is engaged with the actuator pin 38 of the actuator lever 14 of the auxiliary switch 10, at the outlet 69 of its first section 68; its deflector flat 74 then causes the actuator pin 38 to be disengaged from the escape lobe 42 of the slot 39 in the casing 11 of the auxiliary switch 10, returning to the main part 40 of the slot 39; finally, the blind end 71 of its second section 70 operates on the actuator pin 38 in the direction that causes the actuator lever 14 of the auxiliary switch 10 to be returned to its initial position.

At the same time, the contact blade members 12A, 12B of the auxiliary switch 10 return to their initial position, in this instance the closed position of the contact blade member 12A and the open position of the contact blade member 12B, by virtue of their inherent elasticity.

If required, the hole 58 in the actuator lever 14 may be used to operate another auxiliary switch or another electrical device, not shown, in a cascade arrangement.

All that is required for this is for the actuator pin 38 of the actuator lever 14 of the other auxiliary switch, or a similar actuator pin provided for this purpose on the other electrical device, to be engaged in the hole 58.

The present invention is not limited to the embodiment and/or use described and shown, but encompasses any variant thereof.

There is claimed:

1. An auxiliary switch for a circuit-breaker including a fuse-holder mobile between an open and closed position, said switch comprising a casing containing at least one contact blade member at least partly mobile, a pivoting and sliding actuator lever for controlling said at least one contact blade member between two positions, including a closed position, in which said at least one contact blade member is in contact with a fixed contact and an open position in which said at least one contact blade member is out of contact with said fixed contact, said actuator lever comprising a lateral actuator pin projecting out of said casing through a slot therein, said slot having a main part and a localized escape lobe located beyond the main part of said slot, said actuator pin being displaceable along the main part and escape lobe of said slot, said actuator pin being in driven engagement with the fuse-holder during at least part of the displacement of the actuator pin in the main part of the slot and out of driven engagement with the fuse-holder when received in the escape lobe of said slot.

2. The auxiliary switch claimed in claim 1, wherein said escape lobe is disposed at one end of said main part.

3. The auxiliary switch claimed in claim 2, wherein said escape lobe comprises an elbowed extension of said main part joined to said main part through a broadly rounded section.

4. The auxiliary switch claimed in claim 3, wherein said main part is substantially rectilinear.

5. The auxiliary switch claimed in claim 1, wherein said actuator lever includes a groove inter-engaged with a lug on said casing, said actuator lever on said casing being pivotally and slideably mounted.

6. The auxiliary switch claimed in claim 1, wherein said actuator lever includes an opening, said contact blade member passing through said opening, and cooperable with a boss flanking said at least one contact blade member.

7. The auxiliary switch claimed in claim 1, wherein said at least one contact blade member is resiliently biased against said fixed contact in said closed position, said boss and fixed contact being located on the same side of said contact member.

8. The auxiliary switch claimed in claim 1, wherein said at least one contact blade member has one end fixed to said casing and a free end cooperable with said fixed contact.

9. The auxiliary switch claimed in claim 1, further comprising a second said contact blade member also at least partly mobile, said pivoting and sliding actuator lever also controlling said second contact blade member between a closed position in which said second contact blade member is in contact with a second fixed contact and an open position in which said second contact blade member is out of contact with said second fixed contact.

10. The auxiliary switch claimed in claim 9, wherein said second contact blade member is on an opposite side of said actuator pin of said actuator lever relative to said first contact blade member.

11. The auxiliary switch claimed in claim 9, wherein one end of said actuator lever is cooperable with said second contact blade member.

12. The auxiliary switch claimed in claim 11, wherein said one end of said actuator lever has a rounded profile.

13. The auxiliary switch claimed in claim 9, wherein one end of said second contact blade member is fixed to said casing, a free end of said second contact blade being cooperable with said second fixed contact.

14. The auxiliary switch claimed in claim 9, wherein at least one of the first and second contact blade members is at least partly elastically deformable and defines resilient means for holding said actuator lever in a stable manner in at least one of said open and closed positions.

15. The auxiliary switch claimed in claim 1, wherein said actuator lever has a lateral bore disposed on a side thereof opposite said actuator pin and axially aligned with another slot similar to and in registry with the first mentioned slot for said actuator pin.

16. The auxiliary switch claimed in claim 1, further comprising a fuse-holder of a circuit-breaker having cam actuating means, describing a path, said circuit breaker casing having an opening for receiving said actuator pin, said cam actuating means including a groove in said fuse-holder for inter-engagement with said actuator pin, said groove having successive first and second sections offset transversely relative to each other, the first and second sections opening freely through an outlet at the end of said fuse-holder onto an edge thereof and said second section having a blind end at a junction of said first and second sections, an entrainment flat on a first flank of said groove facing towards said blind end of said second section and for driving said actuator pin and, on a second flank of said groove, between said blind end of said second section and said entrainment flat, a deflector flat facing towards said outlet of said first section for deflecting said actuator pin.

17. A circuit-breaker including a fuse-holder, an auxiliary switch associated with the fuse-holder, said fuse-holder being mobile between an open and closed position, said auxiliary switch comprising a casing containing at least one contact blade member at least partly mobile, a pivoting and sliding actuator lever for controlling said at least one contact blade member between two positions, including a closed position, in which said at least one contact blade member is in contact with a fixed contact and an open position in which said at least one contact blade member is out of contact with said fixed contact, said actuator lever comprising a lateral actuator pin projecting out of said casing through a slot therein, said slot having a main part and a localized escape lobe located beyond a main part of said slot, said actuator pin being displaceable in the main part and escape lobe of said slot, said actuator pin being in driven engagement with the fuse-holder during at least part of the displacement of the actuator pin in the main part of the slot and out of driven engagement with the engagement means of said fuse-holder when received in the escape lobe of the slot, said casing having an opening on said path, said actuator pin passing through said opening, said cam actuating means including a groove on said fuse-holder for inter-engagement with said actuator pin, said groove having two successive sections offset transversely relative to each other, a first said section opening freely through an outlet at an end of said fuse-holder onto an edge thereof and a second said section having an blind end, an entrainment flat at a junction between said section on a first flank of said groove facing towards said blind end of said second section and drivable by said actuator pin and, on another flank of said groove, between said blind end of said second section and said entrainment flat, a deflector flat facing towards said outlet of said first section and for deflecting said actuator pin.

* * * * *